US006976970B2

(12) United States Patent
Siddhartha

(10) Patent No.: US 6,976,970 B2
(45) Date of Patent: Dec. 20, 2005

(54) HUB ASSEMBLY FOR SIMULTANEOUSLY MOUNTING PLURAL VIBRATING DEVICES

(75) Inventor: Anjani Siddhartha, Sunland, CA (US)

(73) Assignee: Health Devices Corporation, North Hollywood, CA (US)

( * ) Notice: Subject to any disclaimer, the term of this patent is extended or adjusted under 35 U.S.C. 154(b) by 78 days.

(21) Appl. No.: 10/395,705

(22) Filed: Mar. 24, 2003

(65) Prior Publication Data

US 2004/0193079 A1 Sep. 30, 2004

(51) Int. Cl.[7] ..... A61H 1/00
(52) U.S. Cl. ..... 601/46; 601/72
(58) Field of Search ..... 601/46–48, 72

(56) References Cited

U.S. PATENT DOCUMENTS 5,728,050 A * 3/1998 Lin ..... 601/107
5,749,150 A * 5/1998 McDermott ..... 33/361

FOREIGN PATENT DOCUMENTS

JP 405300943 A * 11/1993

* cited by examiner

*Primary Examiner*—Michael A. Brown

(57) ABSTRACT

A hub assembly for simultaneously mounting one or two vibrating devices has a central body portion, a first end portion adapted to removably connect to a first vibrating device, and a second end portion adapted to removably connect to a second vibrating device. The central portion has a control system for controlling power and function to the first and second vibrating devices mounted on the first and second end portions, a power level/function indicator display, and may have a power source adapted to provide power to both vibrating devices.

23 Claims, 5 Drawing Sheets

HUB ASSEMBLY FOR SIMULTANEOUSLY MOUNTING PLURAL VIBRATING DEVICES

BACKGROUND OF THE INVENTION

1. Field of the Invention

This invention relates to electric vibrators, including therapeutic massage devices and dildos.

2. Description of the Prior Art

By way of background, electric vibrators have been used for therapeutic muscle relaxation purposes, and also for sexual pleasure by individuals and couples alike. An electric vibrator typically comprises an oblong plastic or rubber body having a hollow area therein formed in a molding process. A vibrating motor device is disposed within the hollow area for producing vibrational pulses that pass through the vibrator body. Electrical power is provided by batteries that in some designs are incorporated directly into the vibrator body, and in other designs are incorporated in a separate control unit. The control unit is typically in the form of a handle permanently or removably affixed to the base of the vibrator body, but can also be a switch box connected to the vibrator with a length of insulated wiring.

Vibrators of the foregoing type are conventionally adapted for stimulating one body location at a time on one person. In use, the user grasps the base end of the vibrator, or the attached handle if one is present, and rests the opposite end of the vibrator against the desired location. If it is then desired to stimulate a different location on the same individual, or on a different individual, the vibrator must be removed from the first location and applied to the new location.

There are times when it may be desirable to simultaneously stimulate two body part locations on the same person, or on two different people. For example, one individual might wish to have both feet vibrated at the same time. Alternatively, two individuals may desire to simultaneously stimulate sexually sensitive areas on each other.

Accordingly, it would be desirable to provide a vibrator whose capabilities are not limited in the manner described above. What is needed is a vibrating device or system capable of simultaneously stimulating more than one body part location on the same or different individuals. Preferably, such a device or system would allow the selection of different vibrator configurations and vibrator control settings for use on separate body locations, such that one body location can be stimulated by one vibrator type, while another body location is stimulated by another vibrator type, and which can be easily interchangeable when a different size or shape vibrator is desired.

SUMMARY OF THE INVENTION

The foregoing problems are solved and an advance in the art is obtained by a novel hub assembly for simultaneously mounting plural vibrating devices to be used simultaneously on different body locations of one or more individuals.

In exemplary embodiments of the invention, the hub assembly comprises a first end portion adapted to removably connect to a first vibrating device, a second end portion adapted to removably connect to a second vibrating device, a central body portion disposed between the first end portion and the second end portion, and a control system for selectively controlling the first and second vibrating devices when mounted on the first and second end portions. Electrical contact connectors on the first and second end portions provide electrical communication between the hub assembly and the first and second vibrating devices when mounted thereon.

The central body portion can take a variety of shapes, but will typically be cylindrical and have a longitudinal axis, with the first and second end portions being coaxially disposed on the longitudinal axis. The central body portion may also comprise a compartment where a power source, such as a battery, is carried. Alternatively, batteries could be carried within the first and second vibrating devices. The first and second end portions can have rotatable coupling configurations, such as threads or twist interlocks, for removably connecting to the first and second vibrating devices. A removable cap can be mounted on the first or second end portions when a vibrating device is not attached thereto. The control system may include power and function controls for adjusting variable actions of the first and second vibrating devices. The control system can further include a power level/function indicator display for monitoring the control of such actions.

BRIEF DESCRIPTION OF THE DRAWINGS

The foregoing and other features and advantages of the invention will be apparent from the following more particular description of preferred embodiments of the invention, as illustrated in the accompanying Drawings, in which.

DETAILED DESCRIPTION OF THE PREFERRED EMBODIMENTS

Figure 1:
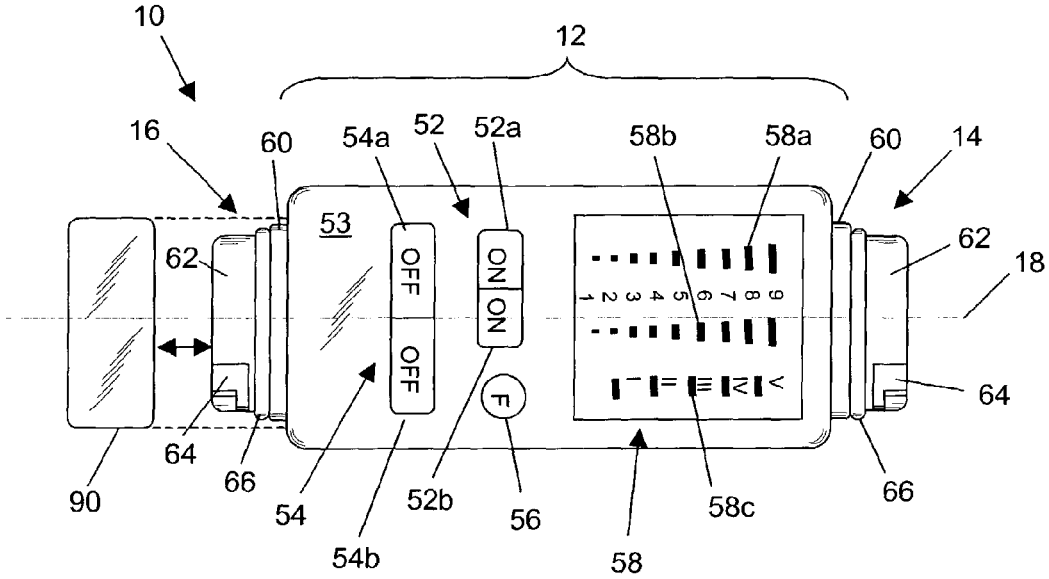
FIG. 1 is a partially exploded plan view showing a hub assembly constructed in accordance with the invention.

The invention will now be described by way of exemplary embodiments shown by the drawing figures, in which like reference numerals indicate like elements in all of the several views.

Figure 2:
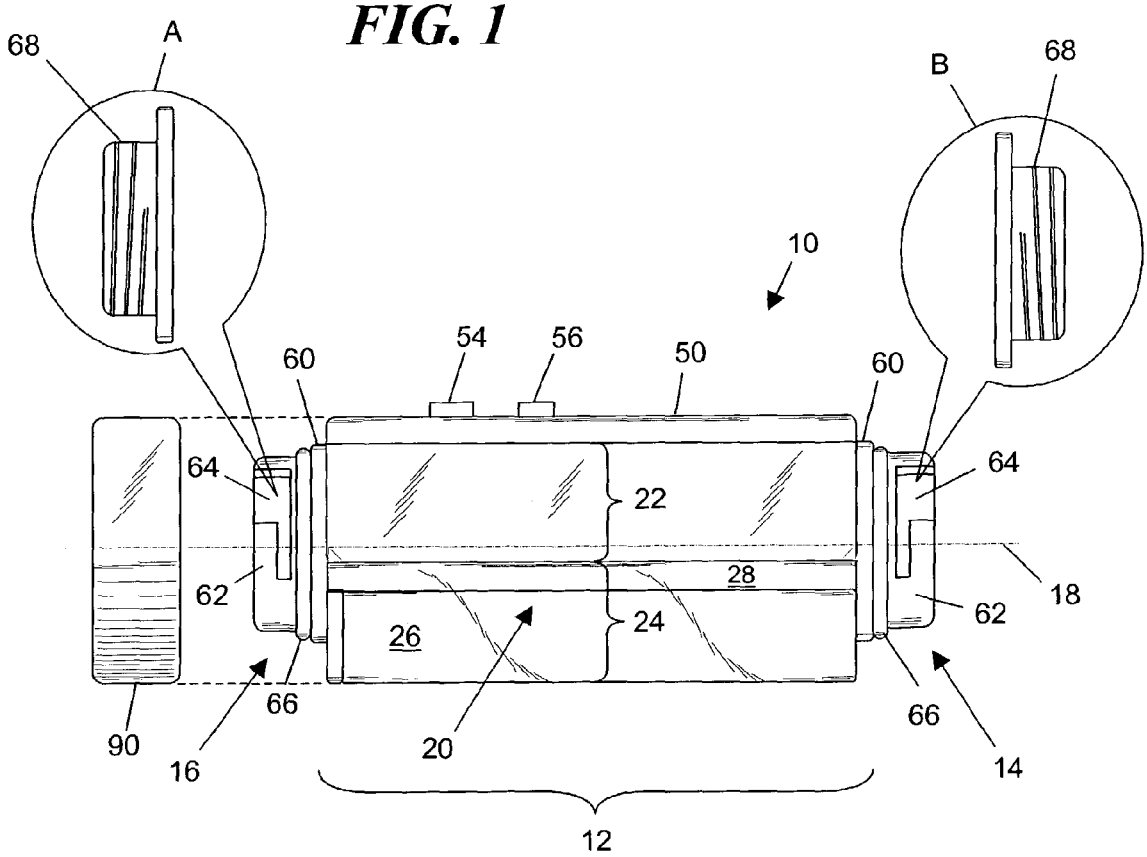
FIG. 2 is a partially exploded side view of the hub assembly of FIG. 1.
Figure 3:
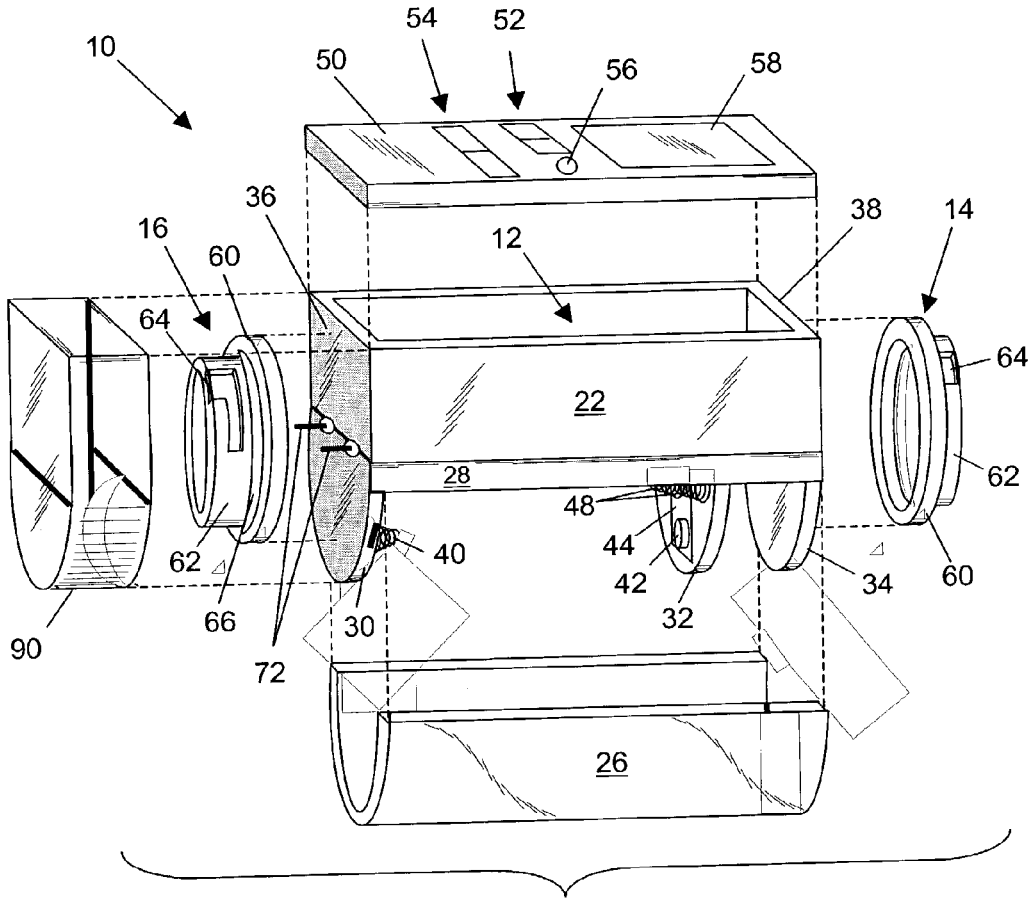
FIG. 3 is an exploded perspective view of the hub assembly of FIG. 1.

Turning to FIGS. 1–3, a hub assembly 10 is constructed in accordance with the invention as a central body housing 12, a first vibrator coupling connector 14 associated with one end of the central body housing 12, and a second vibrator coupling connector 16 associated with the opposite end of the housing 12. Except as otherwise indicated below, it will be assumed that the components 12, 14 and 16 are principally made from a suitable molded thermoplastic plastic material, although other materials, such as relatively stiff silicone rubber or a metal formed by casting, extrusion or machining, could also be used.

The central body housing 12 is formed as an elongated structure having a longitudinal axis 18 on which the first vibrator coupling connector 14 and the second vibrator coupling connector 16 are coaxially disposed. The central body housing 12 is formed with a hollow compartment 20 that is adapted to receive an internal battery power source (not shown), such as four AAA cells. As can be seen with additional reference to FIG. 4, the compartment 20 is defined by an upper section 22 that is generally rectangular in cross sectional shape, and a lower section 24 that extends downwardly from the upper section 22 and has a partially circular cross-sectional shape. A substantial portion of the lower section 24 is formed by a semicircular cover 26 that is slidably removable relative to a fixed portion 28 of the lower section 24 that is integrally formed with the upper section 22. The cover 26 is removable in order to facilitate access to the compartment 20 and to replace the power source therein. In an alternative configuration, the central body portion 12 may be constructed without a smaller compartment when a vibrating device to be mounted on the hub assembly 10 carries its own power source. As can be best seen in FIG. 3, the lower section 24 of the compartment 20 is shown to further include three downwardly extending flanges 30, 32 and 34 that are semicircular in cross-sectional shape. The end flanges 30 and 34 represent extensions of a pair of end walls 36 and 38 of the upper section 22 of the compartment 20. The end walls 36 and 38, including the end flanges 30 and 34, carry the vibrator coupling connectors 14 and 16. The end flange 30 also carries an electrical spring connector 42 while the intermediate flange 32 carries a button-type electrical connector 44. An electrical strip 46 is shown to provide a current pathway to the connector 44. A similar current pathway is provided to the spring connector 40 but is hidden from view. The connectors 40 and 42 are designed to engage one individual battery cell of the power source. Other electrical spring connectors and electrical strips are also disposed within the compartment 20. However, with the exception of the two spring connectors 48 situated above the button connector 44, all are hidden from view.

The central body housing 12 is further formed with a control panel cover 50 that mounts on top of, and covers, the upper section 22 of the compartment 20. The control panel cover 50 mounts several function controls that provide a hub assembly control system. These function controls include a first power switch pair 52, a second power switch pair 24, and a function selector button 56. The first power switch pair 52 and the second power switch pair 54 are preferably constructed as conventional button-type electrical power contact switches. Although not shown, they are connected to conventional variable resistance control circuitry mounted on a circuit board situated below the control panel cover 50.

The power switch pairs 52 and 54 each include two control buttons for respectively controlling power to the first vibrator coupling connector 14 and second vibrator coupling connector 16. More particularly, the first power switch pair 52 comprises a first power control button 52*a* and a second power control button 52*b*, both of which are labeled "ON" in FIG. 1. The first power control button 52*a* is used to effect incremental increases in power to a first vibrating device mounted on the first vibrator coupling connector 14, and the second power control button 52*b* is used to effect incremental increases in power to a second vibrating device mounted on the second vibrator coupling connector 16. The second power switch pair 54 comprises a first power control button 54*a* and a second power control button 54*b*, both of which are labeled "OFF" in FIG. 1. The first power control button 54*a* is used to effect incremental decreases in power to a first vibrating device mounted on the first vibrator coupling connector 14 and the second power control button 54*b* is used to effect incremental decreases in power to a second vibrating device mounted on the second vibrator coupling connector 16.

The function selector button 56, which is labeled "F" in FIG. 1, is preferably constructed as a conventional button-type electrical contact switch that is connected to conventional control circuitry mounted on the circuit board (not shown) situated below the control panel cover 50. The function selector button 56 is used to effect selection of variable actions, such as gyration and the like, of vibrating devices respectively mounted on the first and second vibrator coupling connectors 14 and 16.

The central body housing 12 may also mount a power level/function indicator display 58 on the control panel cover 50. The power level/function indicator display 58 comprises a first vibrating device power level indicator array 58*a*, a second vibrating device power level indicator array 58*b*, and a function indicator array 58*c*. The power level indicator arrays 58*a* and 58*b* may be constructed using conventional LED's that are of increasing width and marked with a numerical scale. The arrays 58*a* and 58*b* are thus adapted to indicate varying levels of power sent to the first and second vibrator coupling connectors 14 and 15. The function indicator array 58*c* may be constructed using conventional LED's that are marked to signify different operative functions of vibrating devices mounted on the first and second vibrator connectors 14 and 16 as the function selector button 56 is activated. Note that FIG. 1 shows an embodiment wherein a single function selector button 56 and function indicator array 58*c* are used to control, in unison, a pair of vibrators respectively attached to the first and second vibrator coupling connectors 14 and 16. However, two function selector buttons 56 and function indicator arrays 58*c* could be used for separate control of each vibrating device if desired.

The first and second vibrator coupling connectors 14 and 16 of the hub assembly 10 are adapted to removably connect to first and second vibrating devices. Each extends axially outwardly from one of the end walls 36 and 38 of the central body housing 12. A base flange 60 on each of the vibrator coupling connectors 14 and 16 is adapted to facilitate end wall mounting by way of a suitable adhesive or fastener system (not shown). Each vibrator coupling connector 14 and 16 also includes a generally tubular vibrator mounting post 62 extending from its base flange 60. The mounting posts 62 are constructed with rotatable coupling configurations that provide a mechanism for receiving and locking vibrating devices to the hub assembly 10 by way of rotational motion. In FIGS. 1–4, the rotatable coupling configurations are implemented on each mounting post 62 as a pair of "twist interlock" slots 64 situated 180 degrees from each other on the mounting post. Each pair of twist interlock slots 64 is conventionally configured to receive a corresponding pair of opposing lock tabs extending radially inwardly on the base end of a vibrating device. Locking is carried out by way of the usual "push-and-twist" motion. In order to provide a positive axial bias on a vibrating device when it is so mounted, a resilient "O" ring 66 is preferably seated at the base of the mounting post, against the base flange 60 and within an annular receiving groove (not shown). The "O" ring 66 is especially helpful for withstanding unlocking as a result of vibrational motion of the vibrating device. As can be seen in FIG. 2, other forms of rotatable coupling configurations may also be used, such as a male thread pattern 68 as shown in the insets "A" and "B" of FIG. 2. It will also be appreciated that the vibrator coupling connectors 14 and 16 could be formed with female coupling configurations to receive male coupling configurations formed on vibrating devices. All of the foregoing coupling configurations allow for easy and quick mounting of the vibrating devices as well as subsequent removal if the vibrating devices are to be changed.

Figure 4:
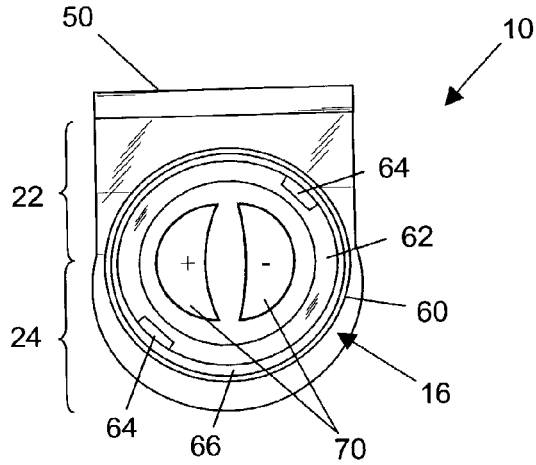
FIG. 4 is an end view of the hub assembly of FIG. 1.
Figure 5A:
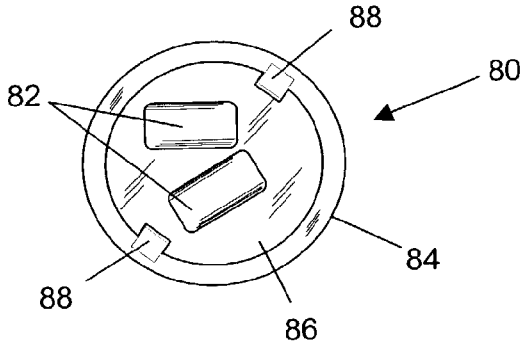
FIG. 5A is an end view of an exemplary type of vibrating device that can be attached to the hub assembly of FIG. 1.
Figure 5B:
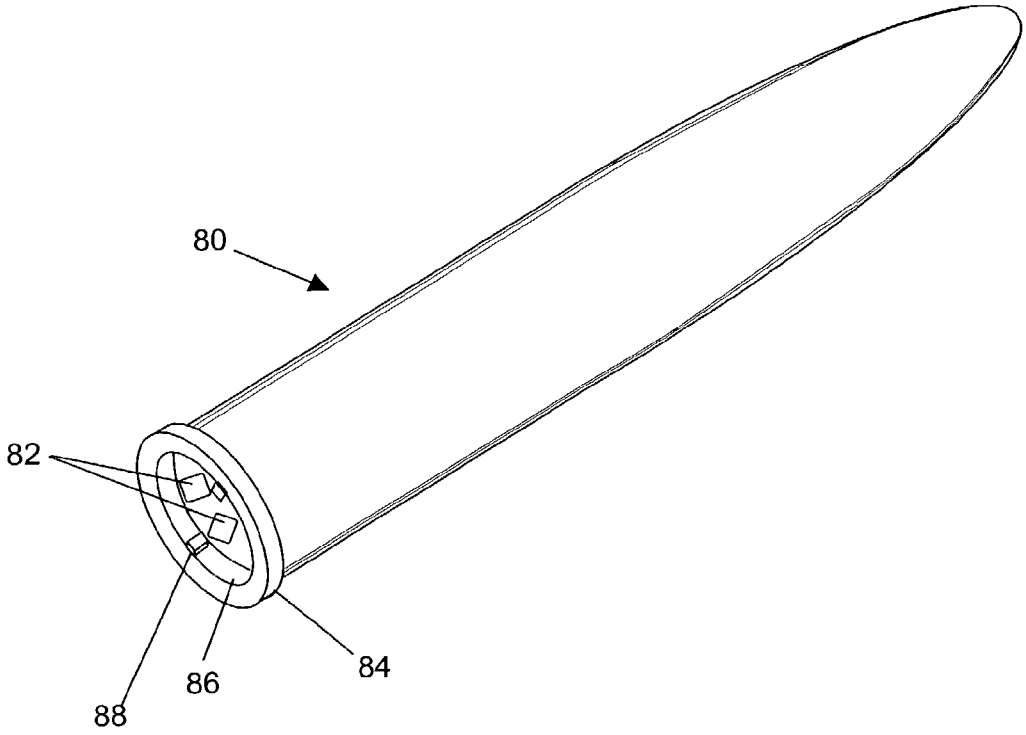
FIG. 5B is a perspective view of the vibrating device of FIG. 5A.

As shown in FIG. 4, the first and second vibrator coupling connectors 14 and 16 include positive and negative electrical contact connectors 70 formed as a pair of metal electrodes supported within the hollow portion of the vibrator mounting posts 62. They are connected to interior electrical components within the central body housing 12 via a pair of pass-through leads 74 that extend through the end walls 36 and 38. The electrical contact connectors 36 are adapted to engage electrical contact connectors on vibrating devices to be attached to the first and second vibrator coupling connectors 14 and 16. One such vibrating device 80 is shown in FIGS. 5A and 5B. It includes electrical contact connectors 82 on a mountable base end 84 of the vibrating device. The electrical contact connectors 82 are positioned to electrically engage the contact connectors 70 on the hub assembly 10, thereby facilitating electrical communication between the hub assembly and the vibrating device 80 when the latter is mounted on the first or second end portions 14 and 16. A vibrator motor (not shown) disposed within the vibrating device 80 is electrically connected to the electrical contact connectors 82. If the hub assembly 10 does not have batteries for providing vibrator motor power, the vibrating device 80 could also house one or more batteries. An inside portion 86 of the mountable base end 84 of the vibrating device 80 is adapted with a rotatable coupling configuration, formed as a pair of lock tabs 88, that correspond to the rotatable coupling configuration on the first and second vibrator coupling connectors 14 and 16.

Figure 6:
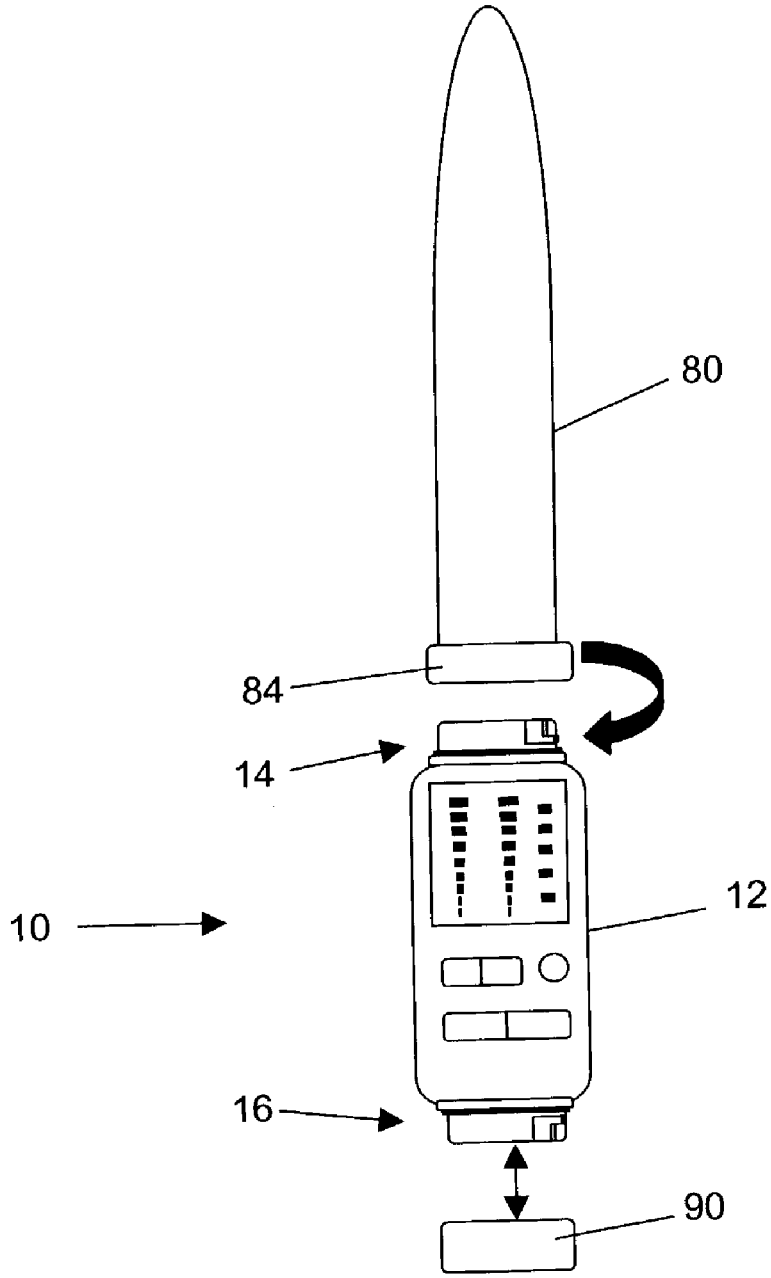
FIG. 6 is an exploded view of the hub assembly of FIG. 1 receiving the vibrating device of FIGS. 5A and 5B, and also showing an end cap to be attached to the hub assembly.
Figure 7:
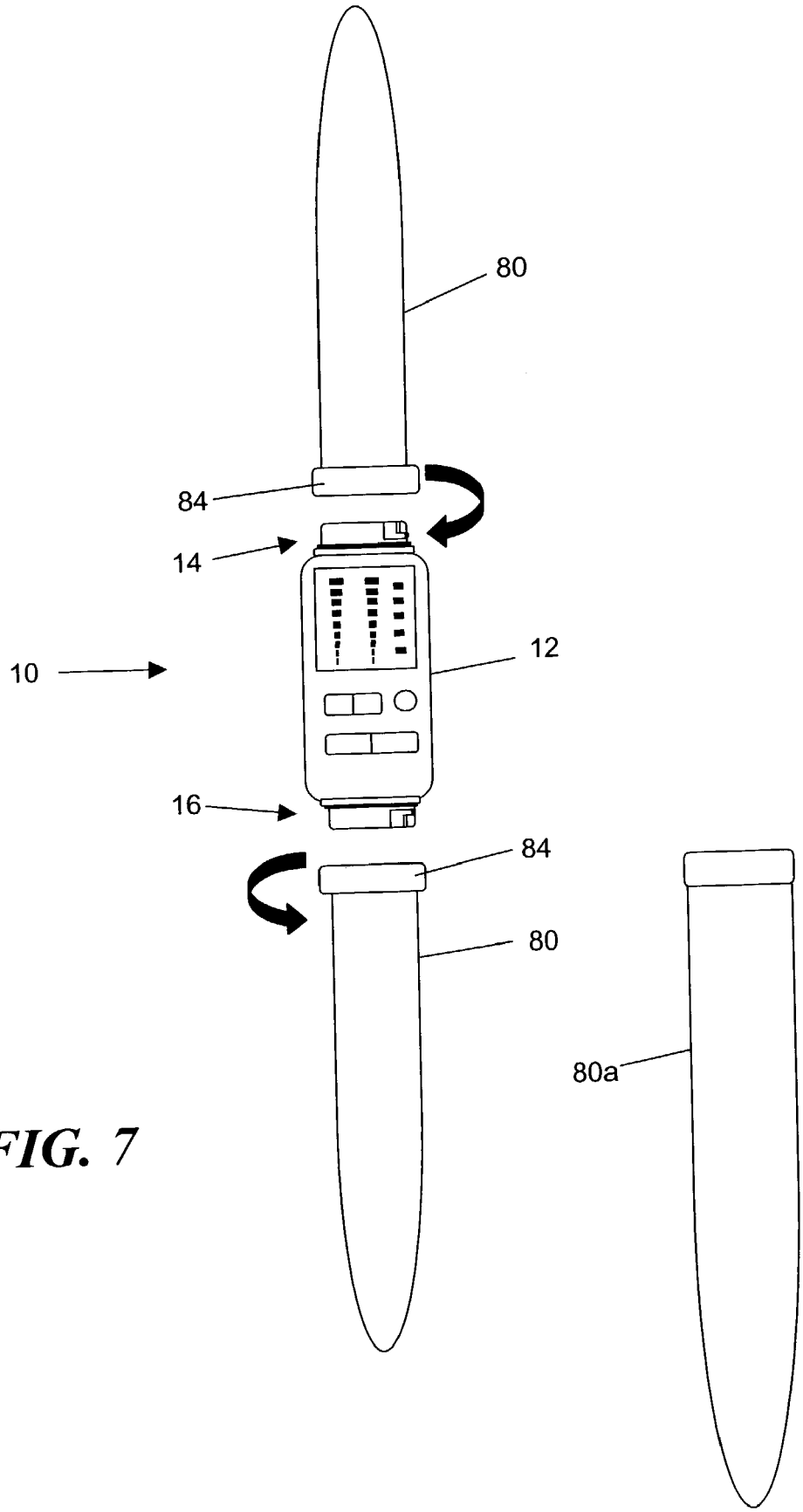
FIG. 7 is an exploded view of the hub assembly of FIG. 1 receiving two of the vibrating devices of FIGS. 5A and 5B.

Turning now to FIGS. 6 and 7, the hub assembly 10 can alternatively mount a single vibrating device 80 (FIG. 6) or a pair of the vibrating devices 80 (FIG. 7). In the single vibrating device configuration of FIG. 6, one vibrating device 80 is removably connected to the first vibrator connector coupling 14 of the hub assembly 10. A cap 90 is mounted on the hub assembly's second vibrator coupling connector 16. FIGS. 1–3 show the cap 90 in more detail. It can be made of plastic or other suitable material, and is provided with an appropriate rotatable coupling configuration, such as a pair of lock tabs (not shown), so that the cap can removably mount to and cover the second vibrator coupling connector 16 when a vibrating device 80 is not mounted thereon. In FIGS. 1–3, the cap 90 is sized so as to cover the entire end wall 36 of the compartment 20. This hides the vibrator coupling connector 16 completely from view, thus providing a pleasing aesthetic effect. If this effect is not required, the cap 90 could be formed as a circular member of smaller size that covers the vibrator coupling connector 16 only, leaving the remainder of the end wall 36 exposed.

In the twin vibrating device configuration of FIG. 7, the two vibrating devices 80 are respectively mounted to the first and second vibrator coupling connectors 14 and 16 of the hub assembly 10. The vibrator user can manipulate both of the vibrating devices 80 by grasping the hub assembly 10 and orienting it in the desired fashion to stimulate separate body regions contacted by the vibrating devices 80. Control over both vibrating devices is conveniently provided by way of the power control and function selector buttons 52, 54 and 56 situated on the control panel cover 50. Given the convenient size and shape of the central body housing 12, single-handed operation and control is thus provided over both of the vibrating devices 80 simultaneously. If two persons are each using one of the vibrating devices 80, one person may control both devices. Alternatively, the two persons could share control over both vibrating devices 80, or they could separately control their own respective devices.

It should be noted that although FIG. 7 shows the hub assembly 10 being mounted with two of the vibrating devices 80, which are identical, one particular advantage of the invention is that different vibrating devices of different size and shape can be used simultaneously with the hub assembly. For example, FIG. 7 shows a larger vibrating device 80*a* that could be mounted to the hub assembly 10 if desired. This feature allows a single user to obtain different vibrating sensations on different areas of the body simultaneously, or on the same body portion in alternating fashion, with selection of the desired vibrating device requiring no more than a 180 degree reorientation of the hub assembly 10. Two persons will also benefit from this feature insofar as each individual can select their own personal preference of vibrating device, mount it to the hub assembly 10, and then share an intimate vibrational experience with their partner.

Accordingly, a hub assembly for simultaneous use with two vibrating devices has been disclosed. While various embodiments of the invention have been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed is:

1. A hub assembly for simultaneously mounting plural vibrating devices, comprising:

a first end portion adapted to removably connect to a first vibrating device;

a second end portion adapted to removably connect to a second vibrating device;

a central body portion between said first end portion and said second end portion; and a control system far controlling power to said first and second vibrating devices when mounted on said first end portion and said second end portion;

said control system comprising:

first and second power switches respectively controlling power applied to said first and second vibrating devices; and a function selector for adjusting variable actions of said first and second vibrating devices.

2. A hub assembly in accordance with claim 1 wherein said central body portion is generally elongated and has a longitudinal axis, and wherein said first and second end portions are coaxially disposed on said longitudinal axis.

3. A hub assembly in accordance with claim 1 wherein said first and second end portions have rotatable coupling configurations.

4. A hub assembly in accordance to claim 3 wherein said rotatable coupling configurations comprise twist interlock configurations.

5. A hub assembly in accordance wit claim 3 wherein said rotatable coupling configurations comprise threads.

6. A hub assembly in accordance with claim 1 further including a removable cap mounted on said first or second end portion.

7. A hub assembly in accordance with claim 1 further including a battery power source adapted to provide power to a vibrating device, and wherein said central body portion comprises a compartment containing said battery power source.

8. A hub assembly in accordance with claim 1 wherein said first and second end portions further include electrical contact connectors adapted for electrical communication between said hub assembly and said first and second vibrating devices when mounted thereon.

9. A hub assembly in accordance with claim 1 wherein said central body portion further includes a power level/function indicator display.

10. A hub assembly for simultaneously mounting plural vibrating devices, comprising:

a first end portion;

means on said first end portion for removably connecting said hub assembly to a first vibrating device;

a second end portion;

means on said second end portion for removably connecting said hub assembly to a second vibrating device;

a central body portion; and control system means for controlling power to said first and second vibrating devices when mounted on said first and second end portion;

said control system means comprising:

first and second power switches respectively controlling power applied to said first and second vibrating devices; and a function selector for adjusting variable actions of said first and second vibrating devices.

11. A hub assembly in accordance with claim 10 wherein said first end portion and said second end portion comprise means for rotatable coupling of said first and second vibrating devices.

12. A hub assembly in accordance to claim 11 wherein said rotatable coupling means comprises twist interlocks.

13. A hub assembly in accordance with claim 11 wherein said rotatable coupling means comprises threat.

14. A hub assembly in accordance with claim 10 wherein said first and second end portions include means for covering said first and second end portions when said first and second end portions are not connected to said first and second vibrating devices.

15. A hub assembly in accordance with claim 10 further including means for providing battery power to said first and second vibrating devices, and wherein said central body portion comprises means for receiving and holding said battery power means.

16. A hub assembly in accordance with claim 10 wherein said hub assembly comprises means for electrical communication between said hub assembly and said first and second vibrating devices when mounted thereon.

17. A hub assembly in accordance wit claim 10 wherein said central body portion further includes means for indicating power level and functions.

18. A central hub assembly simultaneously mounting plural vibrating devices, comprising:

a first end portion adapted to removably connect to a first vibrating device;

a second end portion adapted to removably connect to a second vibrating device;

a central body portion;

a power supply compartment within said central body portion;

first and second power switches on said central body portion, said first and second power switches respectively controlling power applied to said first and second vibrating devices;

a function selector on said central body portion;

a power level/function indicator display on said central body portion;

a first electrical contact connector pair associated with said first end portion and adapted to contact electrical connectors on said first vibrating device;

a second electrical contact connector pair associated wit said second end portion and adapted to contact electrical connectors on said second vibrating device; and a cap adapted to removably connect to one of said first or second end portions when said first or second end portion to which said cap is mounted is not connected to said first or second vibrating devices.

19. A hub assembly in accordance with claim 18 in combination with said first vibrating device mounted on said first end portion and said cap mounted on said second end portion.

20. A hub assembly in accordance with claim 18 in combination with first and second vibrating devices respectively mounted on said first end portion and second end portion and with said cap being removed from said hub assembly.

21. A hub assembly in accordance with claim 20 wherein said first and second vibrating devices arc of identical size and shape.

22. A hub assembly in accordance with claim 20 wherein said first and second vibrating devices are of different size and shape.

23. A hub assembly in accordance with claim 18 wherein said central body portion is sized for single-handed gripping.

* * * * *

UNITED STATES PATENT AND TRADEMARK OFFICE

CERTIFICATE OF CORRECTION

PATENT NO. : 6,976,970 B2
DATED : December 20, 2005
INVENTOR(S) : Anjani Siddhartha It is certified that error appears in the above-identified patent and that said Letters Patent is hereby corrected as shown below:

Column 6,
Line 41, change “far” to -- for --;

Column 7,
Line 37, change “threat” to -- threads --;

Column 8,
Line 24, change “wit” to -- with --;
Line 42, change “arc” to -- are --.

Signed and Sealed this

Fourteenth Day of February, 2006

JON W. DUDAS
*Director of the United States Patent and Trademark Office*